United States Patent [19]

Van Hout et al.

[11] Patent Number: 4,883,932

[45] Date of Patent: Nov. 28, 1989

[54] LINKAGE-TYPE SWITCHES FOR CONTROL PANEL ACTUATORS

[75] Inventors: James E. Van Hout, Auburn Heights; Lee M. Dziekan, East Detroit, both of Mich.

[73] Assignee: Chrysler Motors Corporation, Highland Park, Mich.

[21] Appl. No.: 229,741

[22] Filed: Jun. 6, 1988

Related U.S. Application Data

[63] Continuation of Ser. No. 87,728, Aug. 21, 1987, abandoned.

[51] Int. Cl.[4] ..... H01H 23/30

[52] U.S. Cl. ..... 200/339; 200/337; 200/557; 200/561

[58] Field of Search ..... 200/339, 153 K, 330, 200/331, 337, 315, 557, 561, 553

[56] References Cited

U.S. PATENT DOCUMENTS 3,965,315 6/1976 Waenn ..... 200/330

4,401,864 8/1983 Ichikawa ..... 200/339

*Primary Examiner*—Renee S. Luebke

*Attorney, Agent, or Firm*—Wendell K. Fredericks

[57] ABSTRACT

Operation of a pair of switches mounted on a circuit board is effected by a rocker-type actuator mounted in an escutcheon plate of a control panel spaced a substantial distance from the circuit board. Elongated compressible plungers linking the actuator to the switches and associated operating structure are used to change rocking motion of the actuators about a rocking axis into a linkage type motion of the plungers for activating the switches mounted on the circuit board.

2 Claims, 2 Drawing Sheets

LINKAGE-TYPE SWITCHES FOR CONTROL PANEL ACTUATORS

This is a continuing application of application Ser. No. 07/087,728 filed Aug. 21, 1987 and assigned to the same assignee as the present application and now abandoned.

CROSS REFERENCE TO RELATED APPLICATIONS

This application is related to the pending patent application entitled, "Linkage Type Switch Mechanism" filed on Aug. 21, 1987 by James E. Van Hout and Lee M. Dziekan having the Ser. No. 07/087,729 and assigned to the same assignee named herein and is related to patent application entitled, "Panel Displays, Framed Lighted Switch Actuators Therefor" filed on Jan. 20, 1987 by James E. Van Hout and Frank H. Klien now U.S. Pat. No. 4,710,858 dated Dec. 1, 1987 and assigned to the same assignee named herein.

BACKGROUND OF THE INVENTION

The present invention concerns a linkage-type switch mechanism, and more particularly, a switch mechanism of the type in which a sliding-block linkage operation occurs to actuate a switch, having an extended and flexible switch plunger, mounted at a remote location in response to operating a rocker-type actuator.

DESCRIPTION OF THE PRIOR ART

Normally, a rocker-type actuator mounted on an escutcheon plate of a control panel is used to control two separate switch circuits on a printed circuit board. The two switches controlling the circuits are spaced on the board so that plungers that extend from the top of the switches can mate with the underside of the actuator. Also, the circuit board is moved into close proximity to the underside of the actuator so that distal free ends of the plungers can contact the underside of the actuator.

When there is a need to space the circuit board at a relatively large distance from the escutcheon plate, coupling posts or similar structures are attached to two locations on the underside of the actuator in order for the actuator to rock in a see-saw manner about a pivotal axis in an opening in the escutcheon plate yet the posts still reach a top end of each of the two switches on the circuit board. If the distance between the escutcheon plate and the circuit board becomes too great, the attached posts are ineffective in actuating the switches because the posts cannot maintain a coupled relationship with the top end of each of the two switches. This occurs because the ends of the posts slide laterally away from the ends of the switch plungers. This type mechanism follows the motion laws that govern cams wherein a plate (the actuator) communicates motion to a follower (the switch) by means of a stroke of a driver (a plunger) of the actuator against the top of the switch in response to pressing the actuator. The switch must assume a definite series of positions while the plunger occupies a corresponding series of positions or the top of the switch must arrive at a definite location by the time the plunger arrives at a particular position. With long plungers attached to the actuator, such cam action is difficult to achieve without guides. Therefore, other means must be sought to couple the actuator to the two switches.

In the prior art, a long stem switch assembly is described in U.S. Pat. No. 4,425,487 of S. Hsieh dated Jan. 10, 1984. There, a unitized manual actuator assembly is attached to a printed curcuit board for operating poppet switches mounted thereon. The actuator assembly comprises a two-piece housing having a pair of integral tube guides disposed in the housing. A pin is slidably disposed in each tube guide with one end protruding out of the housing for operating the switches. The internal end of each pin has an integral hollow cap covering and protecting the upper open end of its associated tube guide. A coil spring surrounds each tube guide and engages the internal hollow cap of the pin to bias it against a rocker member pivotally mounted in the housing. The rocker member has an operator portion extending through an opening in the housing and a pair of oppositely extending arms engages the hollow caps so that the pin translates in opposite directions when the rocker member is pivoted. This arrangement permits long pins to extend from the switches on the printed circuit board, but holow caps must be used over the pins and tube guides and coil springs surrounding the guides are used cause the pins to translate vertically while the extension arms of the rocker member slide laterally across the top of the hollow cap when the operator is actuated.

SUMMARY OF THE INVENTION

The present invention is concerned with a dual switching actuator and associated switch circuit components disposed on a printed circuit board. The switch circuit components and the actuator allow for increased spacial distance between the circuit board and the actuator. Dual switches in the switch circuits on the printed circuit boards are equipped with elongated elastic material plungers that extend to permit direct coupling with the underside of the actuator so as to cause lateral flexing of an end of the plunger when the actuator is rocked about a pivotal axis to activate the switch on the printed circuit board. Means are provided for guiding and retaining the extended plungers in coupled relationship with the underside of the actuator forming a linkage as the actuator is rocked in either direction about the pivotal axis and as the actuator returns to an original, inoperative position.

BRIEF DESCRIPTION OF THE DRAWING FIGURES

Figure 5:
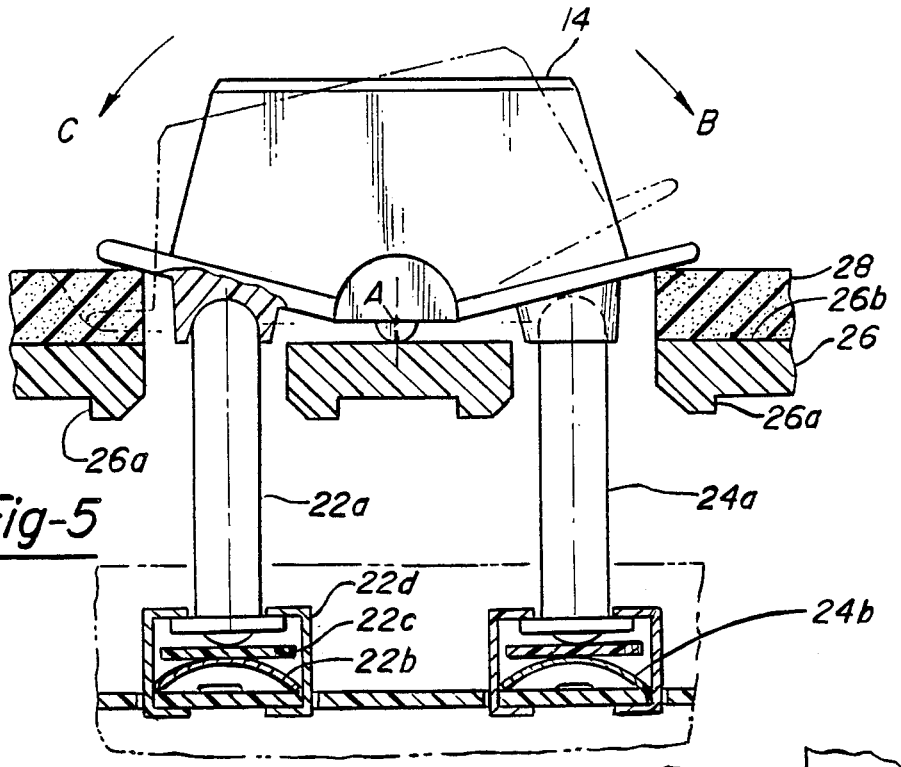
Figure 7:
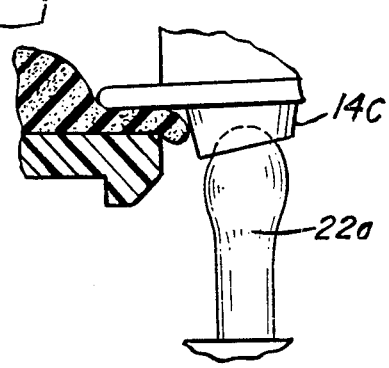
Figure 6:
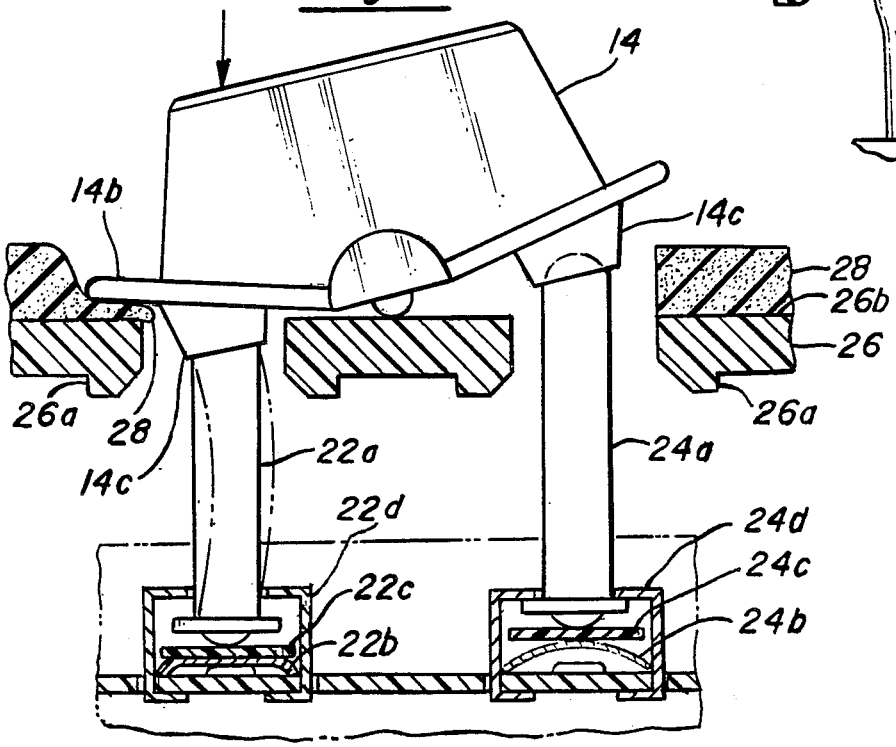

FIG, 4 is sectional view of a switch that utilizes a snap-dome disk device and the plunger of the present invention;

FIG. 5 is an exploded cutaway view of the switch, circuit board and actuator assembly;

FIG. 6 is an exploded cutaway view of the assembly illustrative of a load being applied to one side of the actuator and the elastic material plunger flexing in response to the load while structural members absorb most of the load force; and FIG. 7 is illustrative of another embodiment of the elastic material plungers.

DESCRIPTION OF A PREFERRED EMBODIMENT

Figure 1:
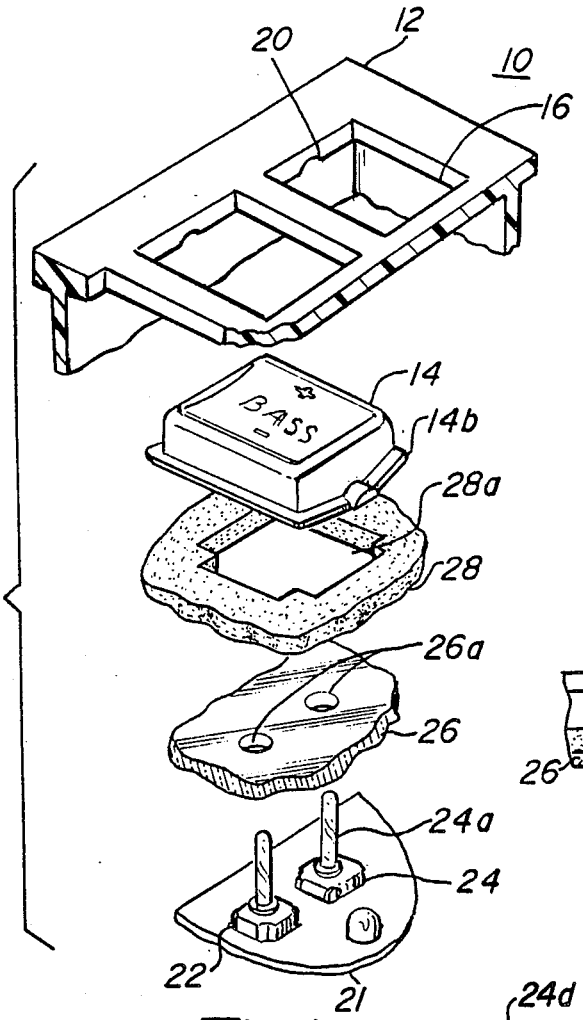
FIG. 1 is an exploded fragmentary section of a perspective view of a control panel utilizing rocker-type actuators and long plunger switches of this invention.
Figure 2:
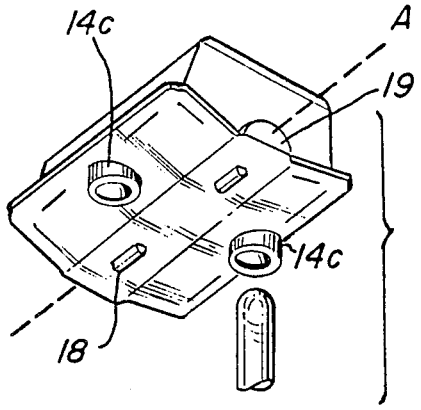
FIG. 2 is a perspective view depicting the receptacle ports on the underside of a rocker actuator for receiving the distal free end of the plungers of the circuit board switches.

Referring now to FIGS. 1 through 7, there is shown in FIG. 1 an exploded fragmentary perspective view of a control panel 10, e.g., for a car radio equipped with a rocker actuator 14. Actuator 14 rocks back and forth within an opening 16 in an escutcheon plate 12 of the control panel 10 to control two different circuits. Illustratively, actuator 14 is a "BASS" control switch comprised of two sections. By pressing a plus (+) section of actuator 14, a momentary-action switch 24 is closed that makes a circuit that controls increases in "BASS" response; and by pressing the negative (−) section of lever 14, another momentary-action switch 22 is closed that makes a circuit that controls decreases in "BASS" response.

Figure 3:
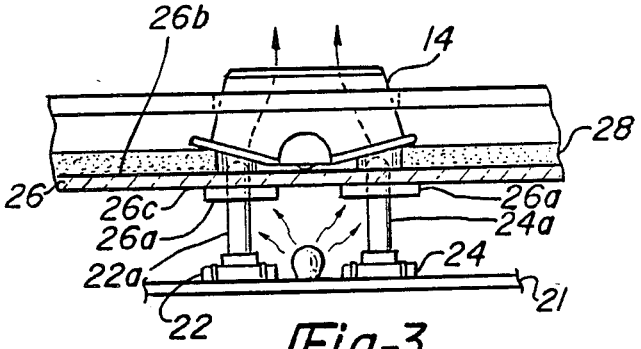
FIG. 3 is a composite side view of the assembly shown in FIG. 1 illustrative of the relationship between the long plunger switches and the rocker actuators.
Figure 4:
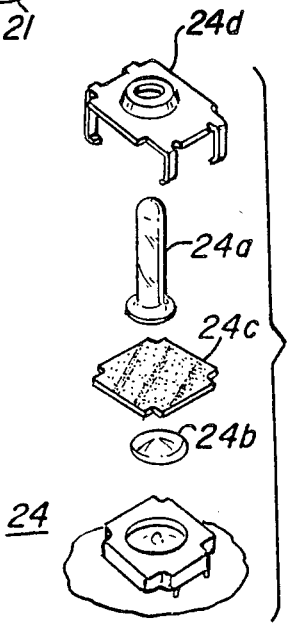

Illumination of panel 10 is accomplished by backlighting as shown in FIG. 3. Backlighting emanates from light sources 23 disposed at selected locations on the front of a circuit board 21, the circuit board being spaced apart from the escutcheon plate a chosen distance. The light from sources 23 provide adequate lighting levels so as to illuminate the legends 14*a* on the face of all the rocker actuators mounted on the escutcheon plate. The underside 14*d*, as shown in FIG. 3 of the actuator 14 and all other actuators used on panel 10 are transparent, permitting light to reach the back of the legend material which is translucent surrounded by an opaque material.

Rocker actuator 14 includes a frame 14*b* which enclosed the peripheral edge of actuator 14 and is usually intended for blocking the passage of light which may seep through the openings 16 in the escutcheon plate while actuator 14 is in either a neutral or an operating position.

To assist in opposing manual forces that could dislodge actuator 14 from the opening 16 in the escutcheon plate 12, a rigid transparent molded plastic structure possessing light distribution characteristics is mounted to the escutcheon plate in spaced-apart relationship with a layer of an opaque foam 28 sandwiched therebetween. The foam adjacent to the openings 28*a* is used to provide a resilient reaction against a portion of the underside of actuator 14 to cause the actuator to return to a neutral inoperative position after being pressed and released.

For actuator 14 to rock back and forth within the opening 16 in the escutcheon plate with frame 14*b* attached, means must be provided for revolving actuator 14 about the pivotal axis between two extreme positions as indicated in FIG. 5. As shown there, for actuator 14 to revolve about axis "A", so as to press plunger 22*a* of switch 22 in a direction "C" and then to press plunger 24*a* of switch 24 in a direction "B", means must be provided to enable revolvement about axis "A".

Thus, a first pair of fixedly mounted half bearings 19 of a first size, each one of which being mounted at opposite ends of actuator 14 along axis "A". which revolves within a pair of arch-shaped grooves 20 in a bottom surface of escutcheon plate 12 is used along with a second pair of fixedly mounted half bearings 18 of a second size, each of which being mounted in line with axis "A" on the underside of rocker actuator 14. As shown in FIG. 3, bearings 18 bear against a top surface 26*b* of the transparent structure 26. It should be recognized by those skilled in the art that a single-half bearing could be employed to achieve a similar effect.

The top surface 26*b* of the transparent structure 26 as shown in FIG. 3 provides a substantially rigid flat surface for the second pair of half bearings 18 to bear upon in response to the rocker actuator being pressed.

A pair of guide ports 26*a*, molded to the transparent structure 26 below the actuator, guide the elongated plungers of the switches through the transparent structure, during the assembly steps, permitting interfacing of the distal free ends of the switch plungers with receptacle ports 14*c* of FIG. 5 formed on the underside of the levers.

Illustratively, actuator 14 can be rocked in a seesaw manner about rotational axis "A" of FIG. 5 when force is applied reciprocally to the plus section and minus side of the face. If the plus section is pressed, a moment arm of, e.g., 0.375 inches pivots about axis "A" in an arc of about 6 degrees in the plus direction to cause elastic material plunger 24*a* which is about 0.75 inches in length to flex as shown in FIG. 6 and to achieve full switch travel such as to apply sufficient force to actuate the snap-dome disk 24*b* in switch 24. When disk 24*b* is actuated, it "makes" or completes the electrical circuit on the printed circuit board 21 of FIG. 3. When the force is removed, the dome snaps back "breaking" the circuit. A similar reaction occurs with switch 22 when force is applied to the minus side of the actuator 14. This arrangement forms a linkage-type switch mechanism utilizing see-saw motion of the actuator to produce a connecting-rod type of motion of the plungers.

To describe the operation of the linkage-type switch mechanism of this invention, reference is made to FIGS. 1, 3, 5 and 6 which are illustrative of a two-circuit switch linkage mechanism, e.g. switch 14 is a bass-control switch on a car radio. Actuator 14 can be rocked in a see-saw manner about rotational axis "A" of FIG. 2 when manual force is applied reciprocally to the plus section and the minus section of the legend on the face of the actuator. This action could alternately cause the bass tone of the radio to increase and decrease if the radio was turned on.

With the radio turned on and it is desired to decrease the bass tone of the radio using rocker actuator 14, which is shown in a neutral position in FIG. 3, manual force is applied to the minus (−) section of the legend on the face of the actuator. The minus section of the actuator acts as a moment arm of, e.g., 0.375 inches that pivots counter-clockwise about axis "A" in an arc and compresses the foam 28 disposed between the frame and the transparent structure 26. The force on the minus side of the legend is transmitted to a ball and socket type joint or couple formed by the distal-end of the compressible material plunger 22*a* engaging the receptacle 14*c* under the minus section of actuator 14. The receptacle 14*c* on the underside of actuator 14 and the switch cover 22*d* maintains plunger 22*a* in coupled relationship with the actuator on the panel 12 and the snap-dome disk 22*b* of switch 22 on the circuit board 21. The joint absorbs a portion of the applied force and follows the counter-clockwise rotation about axis "A" of the minus section of the actuator causing the upper region of the plunger 22*a* to move along an arcuate path from its free position to its operating position as indicated in FIG. 6, distal free-end of plunger 24*a* remains aligned with the other receptacle (best seen in FIG. 6). As actuator 14 rotates, frame 14*b* moves against the foam while plunger 22*a* exerts force against the top of the snap-dome disk 22b. In exerting force against the top of snap-dome disk 22b, the length of plunger 22a decreases substantially. Actuator 14 continues to rotate causing plunger 22a to completely depress the snap-dome disk and continues further until frame 14b bottoms out by completely compressing the foam. The completely depressed snap-dome disk 22b electrically connects an opening in the wire run of a bass tone-decreasing circuit on printed circuit 21 that lies directly under the disk.

When the force on the minus side of the legend is removed, the flexed plunger 22a returns to its free position, the compressed disk snaps back breaking the circuit and the compression of the resilient foam under frame 14b is reduced causing actuator 14 to return to its neutral position.

If it is desired to increase the bass tone, manual force is applied to the plus section of actuator 14 and the identical reaction occurs for switch 24.

This arrangement forms a mechanism that utilizes the moment arm of the actuator about the "A" axis as a crank, the receptacle 14c and the distal-free end of the plunger as a ball and socket joint, the plunger 22a as a flexible connecting rod and the snap-dome disk 24b as a sliding block, i.e., the top of the disk moves in a manner that resembles a sliding block, to form a sliding-block linkage type switch mechanism.

While the present invention has been disclosed in connection with a preferred embodiment thereof, it should be understood that there may be other embodiments which fall within the spirit and scope of the present invention and that the invention is susceptible to modification, variation and change without departing from the proper scope or fair meaning of the following claims.

What is claimed is:

1. A linkage switch-type mechanism for controlling a first and a second electric circuit, comprising:

(a) an actuator member rockably mounted about a rotational axis in an opening of an escutcheon plate of a control panel and having a front face divided to form a first section and a second section for causing angular movement in opposing directions;

(b) first and second switch means occupying remote locations from the rear of said actuator member, substantially in-line with said first and second sections respectively, providing substantially increased clearance between the rear of the actuator member and the first and second electric circuits, said first and second switch means having a first and a second snap-some disk respectively, electrically coupled to the first and second circuits for alternately closing and opening the two circuits in response to angularly driving the first and second sections of said actuator member about the rotational axis, said first and second switch means having first and second elongated and compressible plungers respectively, each of said plungers having a front end for contacting a top location on said first and second disks for connecting said first and second disks to said actuator member;

(c) first and second receptacle means spaced apart on the rear surface of said actuator and in alignment with said first and second sections respectively for receiving a distal end of said first and second plungers respectively so that a ball and socket-type joint is formed linking said first and second switch means to said actuator member;

(d) a returning means comprised of a layer of a resilient foam disposed upon a structural member mounted in spaced-apart relationship to the escutcheon plate, said structural member having a first and second aperture means through which the distal ends of said first and second plungers are routed to be received by said first and second receptacle means so as to maintain the linkage, for returning said actuator member to neutral position after said first and second sections of said actuator member have been driven angularly about the rotational axis, said first and said second aperture means including a first and a second guide port respectively; and (e) a frame encompassing a lower peripheral edge of said actuator member;

said first section of said actuator member when actuated by an actuating force causing said frame to depress the foam of said returning member and causing transmission of the actuating force to the associated ball and socket joint formed by the distal end of said first plunger and said first receptacle means, said joint absorbing a portion of the actuating force, said joint rotating in concert with said first section of said actuator member about the rotational axis of said actuator member causing an upper region of said first plunger to move laterally along an arcuate path from its free position to its operating position while a lower region of said first plunger travels linearly and applies a compressive force against the top surface of said first snap-dome disk causing said first disk to flex inwardly against an opening in the first circuit to complete the circuit, said second plunger remaining positioned between the top of said second disk and said second receptacle means under the unpressed second section of said actuator member, said first disk being completely depressed after flexing inwardly against the opening in the first circuit, the length of said first plunger being substantially decreased as said first section of said actuator member continues to rotate until said frame completely compresses the foam.

2. Mechanism of claim 1 wherein said first and second switch means in combination with said actuator member and said first and second receptacle means forms a dual set of linkages and wherein said first and second plungers compress to a substantially decreased length and then expand after being compressed to return to an elongated length between said first and second receptacle means respectively and the top of said first and second snap-dome disk of said first and second switch means when the first and second sections of said actuator member is alternatively pressed and wherein said first and second plungers are pushbuttons of said first and second switch means respectively.

* * * * *